US005102856A

United States Patent [19]

Doll et al.

[11] Patent Number: 5,102,856

[45] Date of Patent: Apr. 7, 1992

[54] HIGH SOLIDS SELF-CONTAINED PRINTING INK

[75] Inventors: Gary W. Doll, Englewood; Michael E. Seitz, Miamisburg, both of Ohio

[73] Assignee: The Standard Register Company, Dayton, Ohio

[21] Appl. No.: 609,757

[22] Filed: Nov. 7, 1990

[51] Int. Cl.[5] ..... B41M 5/155

[52] U.S. Cl. ..... 503/209; 503/207; 503/214; 503/225; 523/161

[58] Field of Search ..... 503/209, 214, 225, 207; 523/161

[56] References Cited

U.S. PATENT DOCUMENTS

| | | | |
|---|---|---|---|
| 2,730,456 | 1/1956 | Green et al. | 503/214 |
| 3,016,308 | 1/1962 | Macaulay | 503/200 |
| 3,663,256 | 5/1972 | Miller et al. | 503/225 |
| 3,672,935 | 6/1972 | Miller et al. | 503/220 |
| 3,732,120 | 5/1973 | Brockett et al. | 503/209 |
| 3,732,141 | 5/1973 | Brockett et al. | 503/209 |
| 3,914,511 | 10/1975 | Vassiliades | 503/206 |
| 4,010,292 | 3/1977 | Shackle et al. | 427/150 |
| 4,337,968 | 7/1982 | Maierson | 503/207 |
| 4,940,739 | 7/1990 | Seitz | 503/214 |

*Primary Examiner*—Bruce H. Hess
*Assistant Examiner*—T. A. Powers
*Attorney, Agent, or Firm*—Killworth, Gottman, Hagan & Schaeff

[57] ABSTRACT

A high solids contents, aqueous-based, self-contained printing ink is provided including, a non-volatile diluent, an acidic color developer, a binder, and a water soluble surfactant which is compatible with the binder in the ink, but which is incompatible with the binder when the ink has dried. The high solids, self-contained printing ink further includes microcapsules containing a dyestuff precursor that is capable of reacting with the acidic color developer to form a color. The ink may be used to prepare self-contained carbonless copy sheets.

12 Claims, No Drawings

HIGH SOLIDS SELF-CONTAINED PRINTING INK

BACKGROUND OF THE INVENTION

The present invention relates to a high solids content, aqueous-based, self-contained printing ink (SC ink) and method of making, and further, to a carbonless copy paper sheet that has the ink coated thereon.

It is well known to those skilled in the art that pressure-sensitive recording paper, better known as carbonless copy paper, is useful in a variety of systems. For example, computer print outs and other pressure marking applications where it is advantageous to eliminate the necessity of typewriter ribbon or independent ink supply have particular use for such carbonless copy paper. It is also well known that such carbonless copy paper systems are produced by forming a layer of pressure-rupturable microcapsules containing a solution of colorless dyestuff precursor on the back side of the front sheet of paper of a carbonless copy paper set. This coated back side is known as the CB coating. In order to develop an image or copy, the CB coating must be mated with a paper containing a coating of a suitable color developer, also known as dyestuff acceptor, on its front. This coated front color developer coating is called the CF coating. The color developer is a material, usually acidic, capable of forming the color of the dyestuff by reaction with the dyestuff precursor.

Marking of the pressure-sensitive recording papers is effected by rupturing the capsules in the CB coating by means of pressure to cause the dye precursor solution to be exuded onto the front of the mated sheet below it. The colorless or slightly colored dyestuff, or dyestuff precursor, then reacts with the color developer in the areas in which the dye containing microcapsules were ruptured, thereby affecting the colored marking. Such mechanism for the technique of producing pressure-sensitive recording papers is well known.

Further developments in this art have shown that microcapsules containing the dyestuff precursor and the unencapsulated color developer dispersion may be coated onto paper or other substrate in a single coating application. The production of self-contained carbonless copy paper having a color developer, a dyestuff precursor and a common solvent for each maintained in isolation on one surface of paper base is known. Examples of such self-contained carbonless copy sheets are described in U.S. Pat. Nos. 3,663,256, 3,672,935, 3,732,120, 3,732,141. Typically, in these patents one or both of the dyestuff precursor and the color developer are encapsulated and applied to the substrate as single or separate coatings. These coatings used an aqueous-based vehicle over the entire surface of the substrate.

The processes described in these patents have the disadvantage that, following application of the aqueous-based coating composition, a considerable amount of water must be evaporated, thus requiring significant expenditures of energy. Additionally, the need for drying such an aqueous-based coating composition requires the use of a complex and expensive apparatus. More particularly, when removing the water, numerous controls are required for the coating and drying apparatus to prevent sheet distortion, curl or cockle. Special grades of paper are also required to avoid excessive penetration and web breaks on the coating apparatus. The result is a coating and drying apparatus and accompanying facilities that are expensive to build and operate. The centralization of production, due to high capitalization costs, also produces cost inefficiencies in the form of high scrap levels and transportation costs. All of these factors add to the cost of the resulting self-contained sheet.

It is also known that high solids content coatings can be achieved by utilizing a liquid solvent that is capable of dissolving the color-forming reactants but not interfere with the color-forming reaction in a deleterious manner. As taught by U.S. Pat. No. 3,663,256, if a given solvent interferes with the color-forming reaction or diminishes color intensity of the marking, the solvent should be sufficiently volatile to assure its removal from the reaction site after it has brought the color-forming reactants into intimate contact. However, the consistency of these solid solutions and the necessarily volatile solvents used therein give rise to printing problems and cause swelling of rubber plates and rolls. Furthermore, they have high energy requirements and potential environmental contamination problems from the volatile solvents.

Accordingly, in U.S. Pat. No. 4,337,968, it is suggested that a non-volatile organic solvent be used as a partial substitute for the water vehicle. It is stated therein that in combination with an acidic color developer such as phenolic resin, a fatty alcohol, and an amorphous lipophilic silica, the non-volatile solvent improves the characteristics of the coated film because there will be a residue of solvent in the solidified gel structure of the spongy color developer film produced thereby. This high boiling point solvent, as retained in the deposited film, tends to act as a plasticizer and give flexibility to the deposited film, preventing excess dusting during subsequent printing and handling. However, addition of such non-volatile solvent as a water replacement has a detrimental affect on the resultant image intensity of the dried coating. The lowered image intensity in the high solids content, self-contained coating is believed to be attributed to the dilution of the color-forming reactants caused by the addition of the non-volatile solvent.

Also known in the art are the use of binders in order to improve both the rheological properties and the substrate adhesion properties of encapsulated coatings. The rheological properties are extremely important when the coatings are applied to the paper substrate by rotogravure of flexoprinting, as shown in U.S. Pat. Nos. 3,016,308 or 3,914,511. In particular, it is known that the percent solids for an aqueous flexographic self-contained coating must be well below 50% (i.e., 38–42%) or it will otherwise be simply too viscous for application. Binders aid in improving printability of high solids content coatings and further, provide high internal strength within the dried coating. However, binders also reduce image intensity by forming a film between the colorless dyestuff precursor and the acid color developer. Furthermore, the interaction between the non-volatile solvent and the binder creates an inhibitor for the color-forming reactants and thus, precludes complete reaction between the reactants.

Accordingly, there remains a need in this art for high solids content, aqueous-based, self-contained printing ink which has an improved image intensity when printed onto a substrate and has suitable rheological properties for printing carbonless copy paper.

SUMMARY OF THE INVENTION

That need is met by the present invention which provides a high solids content, aqueous-based, self-contained printing ink (hereinafter, SC ink) and a carbonless copy sheet comprising a support sheet having coated thereon the SC ink. The SC ink of the present invention results in an improved image intensity over the traditional self-contained printing ink formulations because of the high solids content thereof. As used herein, high solids contents refers to a self-contained ink having at least 50% solids, by weight in the wet state. Moreover, the present SC ink exhibits suitable rheological properties for printing and produces a carbonless copy paper which is not as subject to the cockling and curling problems associated with prior aqueous-based self-contained inks and which has low energy drying requirements.

In accordance with one aspect of the present invention, a high solids content, aqueous-based, self-contained printing ink is provided and includes an aqueous solution containing a non-volatile diluent, an acidic color developer, microcapsules containing a dyestuff precursor capable of reacting with the acidic color developer to form a color, a binder, and a water soluble surfactant which is compatible with the binder in the SC ink, but which is incompatible with the binder when the ink has dried. The aqueous solution contains at least 50% by weight solids.

The non-volatile diluent acts as a partial substitute for water in the ink, thus increasing the solids content of the ink. It is preferably present in the ink in an amount of from about 15 to 40% by weight. The diluent should be soluble in or miscible with water, and should not increase the viscosity of the ink unduly. In a preferred embodiment of the invention, the non-volatile diluent is selected from the group consisting of polyhydric alcohols such as alpha methyl glucoside, sorbitol and erythritol, polyols, such as polyoxyethylene glycols, amides and ureas such as dimethyl urea.

The acidic color developer may be selected from those compositions known in this art and heretofore used such as zinc salicylate, acetylated phenolic resins, salicylic acid modified phenolic resins, zincated phenolic resins, and novolac type phenolic resins. It is preferably present in the ink in an amount of from about 10–60% by weight.

In regard to the dyestuff precursor-containing microcapsules, the dyestuff precursor may be selected from the many colorless or only slightly colored compositions heretofore used in this art. A preferred group of dyestuff precursor compositions includes triphenyl methanes, diphenyl methanes, leuco dyes, xanthene compounds, thiazine compounds, and spiropyran compounds. The dyestuff precursor is preferably dissolved in an oily solvent such as alkylated naphthalenes, alkylated biphenyls, chlorinated diphenyls, diphenyl methanes, diphenyl ethanes, and alkyl phthalates. In the high solids content ink of the present invention, the dyestuff precursor-containing microcapsules are present in an amount of from about 10–60% by weight.

The oil and dyestuff precursor-containing microcapsules may be produced by any method known in the art so long as the microcapsules are strong enough to withstand the pressures involved with flexographic or offset gravure printing techniques without undue premature rupture. The preferred method of microencapsulation is disclosed in Seitz, U.S. Pat. No. 4,889,877, the disclosure of which is incorporated by reference.

The presence of a binder in the SC ink improves the rheological properties of the ink for better printability. Additionally, the binder promotes good adhesion of the SC ink to the substrate and high internal strength within the printed ink. In a preferred embodiment of the invention, the binder is present in an amount of from about 1–9% by weight and may be selected from the group consisting of starch, casein, polyvinyl alcohol, polyvinylpyrrolidone, carboxylated styrene butadiene latex, and mixtures thereof. Finally, the SC ink of the present invention also includes a water soluble anionic surface active agent which is compatible with the binder in the ink when wet, but which is incompatible with the binder when the ink has dried. A suitable surface active agent (surfactant) may be selected from the class of alkali metal salts of aliphatic, aromatic, and alkyl-substituted aromatic sulfonic acids. Preferred are sodium and potassium salts of alkyl-substituted aromatic sulfonic acids. A preferred water soluble surfactant for this use is sodium alkylnaphthalene sulfonate. Preferably the water soluble surfactant is present in the ink in an amount of from about 0.1–3.0% by weight.

It is the use of this water soluble surfactant component of the present invention which results in an ink which avoids negative rheological properties, such as high viscosity, which is experienced with high solids content, aqueous self-contained printing inks of the prior art that include a binder material. A preferred combination of water soluble surfactant and binder is the use of a polyvinylpyrrolidone binder in the range of 1 to 9% by dry weight and sodium alkylnaphthalene sulfonate in a range of 0.1 to 3% by dry weight. The sodium alkylnaphthalene sulfonate reduces the film forming tendencies of the polyvinylpyrrolidone binder with the color developer and yet does not interfere with the function of the binder in the wet ink. Consequently, the finished carbonless copy paper exhibits an improve image intensity over other carbonless copy papers that use high solids content ink formulations.

An optional component of the present high solids, self-contained printing ink is a filler material in a range of 0 to 30% by dry weight. The filler may be selected from the group consisting of aluminum silicates, calcium carbonates, wax, polyethylene and mixtures thereof. The filler material most preferred in the practice of the present invention is polyethylene.

The present invention also provides a self-contained carbonless copy sheet comprising a support sheet and a coating thereon, the coating comprising a non-volatile diluent, an acidic color developer, microcapsules containing a dyestuff precursor capable of reacting with the acidic color developer to form a color, a binder, and a water soluble surfactant which is compatible with the binder when the coating is wet, but which is incompatible with the binder when the coating has dried.

Accordingly, it is an object of the present invention to provide a high solids content SC ink which may be applied to a substrate using conventional printing techniques and a carbonless copy paper sheet coated with such a printing ink. This and other objects, features and attendant advantages of the present invention will become apparent to those skilled in the art from a reading of the following detailed description of the preferred embodiments and the appended claims.

DETAILED DESCRIPTION OF THE PREFERRED EMBODIMENT

In a preferred embodiment of the present invention, the high solids content, aqueous-based self-contained printing ink (SC ink) may be used to prepare self-contained carbonless copy sheets using simple flexographic or offset gravure printing techniques. The preferred method for applying the printing ink is offset gravure because of its ability to apply a uniform coating at a consistent coating weight.

An important aspect of the present invention is the use of a non-volatile diluent as a partial substitution for the water vehicle in the SC ink. This permits the formulation of an ink having a solids content of at least 50%, significantly greater than the inks of the prior art. The properties the non-volatile diluent should preferably exhibit include: a solubility in water of >33%, a relatively low molecular weight to provide a low, i.e. 50 cps, viscosity solution, non-hygroscopic (or only slightly hygroscopic) and capable of being dried to an essentially tack free state, and possess a vapor pressure of less than 0.1 mm Hg to avoid environmental restrictions and assure worker safety.

A preferred class of compositions for the non-volatile diluent are polyhydric alcohols, such as alpha methyl glucoside. Alpha methyl glucoside is a solid material that is soluble and acts as a liquid when incorporated in an aqueous-based, self-contained printing ink. It has a relatively high (85.5% at 25° C.) hygroscopicity point. As a result, a support sheet such as a paper substrate coated with a polyhydric alcohol exhibits minimal tendencies toward curl and/or sheet distortion. Other polyhydric alcohols which may be used in the present invention include sorbitol, pentaerythritol, glycerol, sucrose, trimethylolethane and trimethylolpropane. Other non-volatile diluents can be selected from the group consisting of polyols, amides, or ureas such as dimethyl urea and dimethyl hydantoin formaldehyde resin. The amount of non-volatile diluent used in the self-contained ink is preferably in the range of from about 15 to 40% by weight.

The acidic color developer may be any type of color developer which is water dispersible and serves as an acidic image former producing a color when in combination with a dye precursor. Preferred are phenolic resins and zinc salicylates with phenolic resin being the most preferred. The amount of color developer present in the ink formulation is preferably in the range of from about 10 to 60% by weight.

A preferred phenolic resin for use in the present invention is a phenol formaldehyde novolac resin. Either what is termed normal novolac resins or zinc reacted novolac resins can be used. Resins reacted with other appropriate cations to enhance reactivity may also be used. Examples of zinc reacted novolac resins and other metal cations which can be used to enhance the reactivity of novolac resins are disclosed, for example, in U.S. Pat. No. 3,372,120. Rather than being zinc-related, the novolac resin may be present with a separate zinc salt, as disclosed in U.S. Pat. No. 3,723,156.

Thus, the color-producing functionality of the phenolic resin is greatly improved when it is present either in conjunction with a zinc salt or in a form which is actually reacted with a zinc compound in order to produce a zincated resin. While the term zinc is being used, because this is the preferred cation, other metal cations may also be used, such as cadmium (III), zirconium (II), cobalt (II), strontium (II), aluminum (III), copper (III), and tin (II).

While water, the non-volatile diluent, and the acidic color developer comprise major ingredients in the high solids content, aqueous-based, self-contained printing ink of the present invention, other important ingredients include a binder and a water soluble surfactant (binder antagonist) which is compatible with the binder in a wet state in the ink, but which is incompatible with the binder when the ink has dried after being printed onto a substrate.

Binders are used to improve the adherence of the SC ink to the support sheet so that the coating on the carbonless copy paper sheet does not easily "dust off." However, excessive amounts of binders have an effect on the image producing ability of the color developer and therefore, reduce the image intensity by forming a film between the colorless dye and the acidic color developer.

Generally, known aqueous binders such as starch, casein, polyvinyl alcohol (PVA), polyvinylpyrrolidone (PVP), and carboxylated styrene butadiene (SBR) latex and mixtures thereof may be used. PVP, which is not subject to biological attack and has a long shelf-life, is the preferred binder for use in the present invention. From about 1 to 9% binder, such as PVP, by weight may be present in the high solids, self-contained printing ink.

Also of importance in the SC ink of the present invention, is the addition of a water soluble surfactant which is compatible with the binder in a wet state in the SC ink, but which is incompatible with the binder when the ink has dried after being printed onto a substrate. The water soluble surfactant is also useful to improve the rheological properties of the ink by reducing the higher viscosity which results from the use of a binder material.

The water soluble surfactant not only reduces the negative film forming properties (which may inhibit the color forming reaction to take place on the printed substrate) of the binder in the dried ink, but additionally allows the aforementioned binder to perform its function in the wet state by dissolving in the aqueous-based ink. However, when the SC ink dries on the support sheet, the water soluble surfactant crystallizes and therefore, is not compatible with the binder material in the dry state. The net result of the inclusion of this water soluble surfactant in the ink formulation is an improved image intensity on the printed substrate without experiencing any undue increase in the viscosity of the ink in the wet printing stage.

The water soluble surfactant is typically a strongly anionic salt chosen from the class of alkali metal salts of alkyl-aromatic sulfonic acids. When using the preferred binder, namely polyvinylpyrrolidone (PVP), the associated preferred water soluble surfactant is sodium alkylnaphthalene sulfonate, preferably in the range from about 0.1 to 3% by dry weight. The use of sodium alkylnaphthalene sulfonate with PVP results in a reduction of visosity associated with the binder material (PVP) in the wet ink yet allows the PVP to perform its function in improving the adherence of the SC ink to the support sheet.

Lastly, an optional ingredient in the SC ink is a filler. The filler component may account for up to 30% by weight of the SC ink of the present invention. However, it should be noted that the filler materials useful in the present invention are essentially chemically inert in both the ink and on the carbonless copy paper sheet and their use is, therefore, optional. Fillers are used simply to add bulk to the SC ink and improve the handling and printing characteristics of the ink. Among the fillers which may be used are the aluminum silicates (clays), the calcium carbonates, and other additives such as wax or polyethylene emulsions, and various mixtures thereof.

As is conventional in this art, small amounts (up to 5% by weight) of other miscellaneous ingredients may be added to the SC ink. Among those ingredients may be a base such as sodium hydroxide, sodium tetraborate (borax), and the like. Likewise, if as mentioned above, shelf-life is being affected by biological attack, such a weak base may be added to make the SC ink more easily printable.

In the preferred embodiment, the SC ink of the present invention includes oil-containing microcapsules that are relatively strong such that they can withstand the pressures involved with flexographic or offset gravure techniques without undue premature rupture. These microcapsules are present in an amount preferably of from about 10 to 60% by weight of the SC ink.

The preferred microencapsulation method is that set forth in U.S. Pat. No. 4,889,877, the disclosure of which is incorporated by reference. However, other interfacial polymerization, interfacial crosslinking methods, or any other known microencapsulation method may also be used. As disclosed in U.S. Pat. No. 4,889,877, an oily solution of a dyestuff precursor in an oily solvent and containing a crosslinking agent is emulsified into an aqueous solution of casein or other polyanion that has been dissolved using a weak base. A polyamine preferably with a functionality of 3 or more, and preferably having a molecular weight of less than 1200, is added either before or after emulsification.

The preferred polyamine also preferably has at least one active hydrogen available on at least two of the three amino groups. Examples of suitable polyamines are diethylenetriamine, bis(hexamethylene)triamine, polyoxypropylenetriamines, polyoxyropylenepolyamines, and amine epoxy adducts (hydroxyalkyl-substituted polyamines).

The polyanion and polyamine form a complex or polysalt which serves as a coreactant for the crosslinking agent. The crosslinking agent, then, is the reactant which reacts with both segments of the polyamine-polyanion complex simultaneously, or with the polyamine segment causing the polyanion segment to precipitate concurrently, or by both mechanisms. Examples of appropriate crosslinking agent reactants are polyisocyanates, polyacid chlorides, polyanhydrides, polyepoxides, polychloroformates, or polyaldehydes. It has been found that the crosslinking agent works best in the system of the present invention when it contains a functionality of at least three.

Isocyanates suitable for this purpose are polyisocyanates and polyisocyanate prepolymers. The term "polyisocyanate" includes polyisocyanates and polyisothiocyanates. Examples of suitable oleophilic polyisocyanates include diisocyanates such as m-phenylenediisocyanate, p-phenlenediisocyanate, 2,6-tolylenediisocyanate, 2,4-tolylenediisocyanate, naphthalene-1,4-diisocyanate, diphenylmethane-4,4'-diisocyanate, 3-3'-dimethoxy-4,4'-biphenyldiisocyanate, 3,3'-dimethyldiphenylmethane-4,4'-diisocyanate, xylylene-1,4-diisocyanate, xylylene-1,3-diisocyanate, 4,4'-diphenylpropanediisocyanate, trimethylenediisocyanate, hexamethylenediisocyanate, propylene-1,2-diisocyanate, butylene-1,2-diisocyanate, ethylidynediisocyanate, cyclohexylene-1,2-diisocyanate, cyclohexylene-1,4-diisocyanate, xylylene-1,4-diisothiocyanate, ethylidynediisothiocyanate, hexamethylenediisocyanate, etc.; triisocyanates such as 4,4',4''-triphenylmethanetriisocyanate, toluene-2,4,6-triisocyanate, etc; and tetraisocyanates such as 4,4'-dimethyldiphenylmethane, 2,2',5,5'-tetraisocyanate, etc. Particularly preferred are the addition product of hexamethylene diisocyanate and hexane triol, the addition product of 2,4-toluenediisocyanate with pyrocatechol, the addition product of toluene diisocyanate with hexane triol, the addition product of toluene diisocyanate with trimethylol propane, the addition product of tetramethylxylene diisocyanate with trimethylol propane, the addition product of hexamethylene diisocyanate with trimethylol propane, or suitable polyisocyanates analogous to the compounds mentioned, or methylene (polyphenyl isocyanate).

Other usable modified isocyanates are those based on hexamethylene-1,6-diisocyanate, m-xylylene diisocyanate, 4,4'-diisocyanato-dicyclohexyl methane and isophorone diisocyanate which contain at least two functional isocyanate groups per molecule. Polyisocyanates based on derivatives of hexamethylene-1,6-diisocyanate having a biuret structure, as disclosed in U.S. Pat. No. 4,051,165, or having an isocyanurate structure are also comprehended.

The oily solution into which the reactant is dissolved preferably contains an oily solvent such as any of the dye precursor solvents normally used in self-contained systems. Suitable materials include alkylated naphthalenes, alkylated biphenyls, chlorinated diphenyls, diphenyl methanes and ethanes, alkyl phthalates, and the like. Additional oily solvent materials which may be employed include the aliphatic and aromatic hydrocarbon oils such as kerosene, mineral spirits, naphtha, xylene, toluene, and the like.

Likewise, with the SC ink typical dyestuff precursors may be used. These include triphenyl methane and diphenyl methane compounds including the well known leuco dyes, xanthene compounds, thiazine compounds, spiropyran compounds, and the like.

The SC ink of the present invention may be readily applied to a support sheet such as a paper substrate, both bond and ground wood, having a weight of from about 45 gm/m$^2$ to 120 gm/m$^2$, or a plastic film such as polyester film, using conventional gravure or flexographic printing equipment. The preferred method, as mentioned above, for applying the SC ink is offset gravure because of the ability to apply a uniform low coat-weight of less than 3 gm/m$^2$.

At low press speeds, the SC ink of the present invention air dries at ambient temperatures. At higher press speeds, in excess of 200 feet per minute, infrared heaters, a small auxiliary hot air dryer or heated rolls may be used to dry the coated support sheet. Commercially available units can be added to existing printing presses without major reconstruction of the printing press.

In order that the invention may be more readily understood, reference is made to the following examples, which are intended to be illustrative of the invention, but are not intended to be limiting in scope.

EXAMPLE 1

With stirring, the following materials were combined to produce a ready-to-use, shelf storage stable, high solids content, aqueous-based, self-contained printing ink.

| | Dry Parts By Weight | Wet Parts By Weight |
|---|---|---|
| Capsule Slurry[1] | 50.50 | 117.44 |
| Phenolic Dispersion[2] | 29.93 | 47.15 |
| Polyhydric Alcohol[3] | 20.00 | 20.00 |
| Polyethylene Emulsion[4] | 1.37 | 3.91 |
| Noncompatible Water[5] | 0.50 | 0.50 |
| Soluble Surfactant Binder[6] | 1.70 | 1.70 |
| | 100.00 | 190.70 |
| Total % Solids | | 52.4% |
| Total Active Phenolic | | 23.6% |
| Total Dye Content | | 2.2% |
| pH | | 6.8% |
| #2 LVT Viscosity @ 3 RPM's | | 850 cps |

[1]Oil-containing microcapsules including a dye precursor prepared according to the teachings of U.S. Pat. No. 4,889,877.
[2]HRJ 4002 Resin from Schenectady Chemicals, Inc.
[3]StaMeg 104 from Horrizon Chemical Div. of A. E. Staley Mfg. Co.
[4]Michem Emulsion 32535 from Michelman Inc.
[5]Nekal BX-78 from GAF Chemicals Corp.
[6]PVP-K30 from GAF Chemicals Corp.

It will be obvious to those skilled in the art that various changes may be made without departing from the scope of the invention which is not to be considered limited to what is described in the specification.

What is claimed is:

1. A self-contained carbonless copy sheet comprising:
a) a support sheet and;
b) a coating thereon, said coating comprising a non-volatile diluent, an acidic color developer, microcapsules containing a dyestuff precursor capable of reacting with said acidic color developer to form a color, a binder, and a water soluble surfactant which is compatible with said binder when said coating is wet, but which is incompatible with said binder when said coating has dried.

2. The carbonless copy paper sheet of claim 1 wherein said non-volatile diluent is selected from the group consisting of polyhydric alcohols, polyols, amides and ureas.

3. The carbonless copy paper sheet of claim 1 wherein said acidic color developer is selected from the group consisting of zinc salicylate, acetylated phenolic resins, salicylic acid modified phenolic resins, zincated phenolic resins, and novolac phenolic resins.

4. The carbonless copy paper sheet of claim 1 wherein said non-volatile diluent is a polyhydric alcohol and said acidic color developer is a phenolic resin.

5. The carbonless copy paper sheet of claim 1 wherein said binder is selected from the group consisting of starch, casein, polyvinyl alcohol, polyvinylpyrrolidone and carboxylated styrene butadiene latex, and mixtures thereof.

6. The carbonless copy paper sheet of claim 1 wherein said water soluble surfactant is sodium alkylnaphthalene sulfonate.

7. The carbonless copy paper sheet of claim 1 wherein said binder is polyvinylpyrrolidone and said water soluble surfactant is sodium alkylnaphthalene sulfonate.

8. The carbonless copy paper sheet of claim 1 wherein said coating also includes a filler.

9. The carbonless copy paper sheet of claim 8 wherein said filler is selected from the group consisting of aluminum silicates, calcium carbonates, wax, polyethylene, and mixtures thereof.

10. The carbonless copy paper sheet of claim 8 wherein said filler is polyethylene.

11. The carbonless copy paper sheet of claim 8 wherein said non-volatile diluent is a polyhydric alcohol, said acidic color developer is a phenolic resin, said binder is polyvinylpyrrolidone, said water soluble surfactant is sodium alkylnaphthalene sulfonate and said filler is polyethylene.

12. The carbonless copy paper sheet of claim 1 wherein said coating comprises, by weight, from about: 15 to 40% of said non-volatile diluent, 10 to 60% of said acidic color developer, 40 to 60% of said microcapsules containing a dyestuff precursor, 1 to 9% of said binder, and 0.1 to 3% of said water soluble surfactant.

* * * * *